US012397894B2

(12) United States Patent
Kusiak

(10) Patent No.: US 12,397,894 B2
(45) Date of Patent: Aug. 26, 2025

(54) USING ACCUMULATOR(S) FOR DYNAMIC POWER STORAGE WITHIN A MULTI AXIS SERVO MOTOR SYSTEM

(71) Applicant: Kevin Kusiak, Fort Lauderdale, FL (US)

(72) Inventor: Kevin Kusiak, Fort Lauderdale, FL (US)

( * ) Notice: Subject to any disclaimer, the term of this patent is extended or adjusted under 35 U.S.C. 154(b) by 616 days.

(21) Appl. No.: 17/861,404

(22) Filed: Jul. 11, 2022

(65) Prior Publication Data

US 2024/0010320 A1 Jan. 11, 2024

(51) Int. Cl.
*B63J 3/04* (2006.01)
*B63J 3/00* (2006.01)

(52) U.S. Cl.
CPC ..... *B63J 3/04* (2013.01); *B63J 2003/002* (2013.01); *B63J 2003/006* (2013.01)

(58) Field of Classification Search
CPC ..... B60J 3/00; B60J 3/04; B63J 3/00; B63J 3/04; B63J 2003/002; B63J 2003/006; B63G 8/00; B63G 8/001; B63C 11/00; B63C 11/52; F15B 1/00; F15B 1/02; F15B 1/027
USPC ..... 114/382
See application file for complete search history.

(56) References Cited

FOREIGN PATENT DOCUMENTS

GB 2571267 A * 8/2019 ..... B63J 3/04

* cited by examiner

*Primary Examiner* — Lars A Olson
(74) *Attorney, Agent, or Firm* — The Rapacke Law Group, P.A.; Andrew Rapacke

(57) ABSTRACT

A system and method of using accumulator(s) to generate electrical power in a marine environment. The system includes a first power source coupled to an electric machine coupled to a hydraulic pump coupled to an accumulator. The first power source is a power supply operable to convert AC to DC, and the accumulator is a high-capacity hydraulic energy storage device. The electric machine configured to operate as an electric motor driving the hydraulic pump in a first direction charges the accumulator. The charged accumulator configured to drive the hydraulic pump in a second direction driving the electric machine configured to operate as an electric generator to generate a second power source. The hydraulic/electric power system also includes a first controller configured to operate a first electrical load powered by the first power source and a second controller configured to operate a second electrical load powered by the second power source.

18 Claims, 5 Drawing Sheets

USING ACCUMULATOR(S) FOR DYNAMIC POWER STORAGE WITHIN A MULTI AXIS SERVO MOTOR SYSTEM

FIELD

The present disclosure relates to a hydraulic/electric power system, and more particularly to hydraulic/electric power systems that prevent sudden electrical load spikes pulling down supply voltage throughout closed electrical systems operating on marine vessels, and methods of using an accumulator to store energy to limit transient electrical loads.

BACKGROUND OF THE INVENTION

Hydraulic/electric power systems are described herein that are particularly suited for use with closed electrical systems in marine environments where transient electrical loads pull down supply voltage throughout a vessel. Among the many benefits that will become apparent to a person skilled in the art upon reading this disclosure is that the described hydraulic/electric power systems greatly reduce the power fluctuations seen in these closed electrical systems.

SUMMARY OF THE INVENTION

In some embodiments, the hydraulic/electric power systems include a first power source coupled to and powering an electric machine, which is coupled to a hydraulic pump, which in turn is coupled to an accumulator. The first power source is configured to draw power from a generator on a vessel or a power grid, and the accumulator is a high-capacity hydraulic energy storage device. The electric machine can be configured to operate as an electric motor driving the hydraulic pump in a first direction which charges the accumulator. The charged accumulator can be configured to drive the hydraulic pump in a second direction driving the electric machine configured to operate as an electric generator and to become a second power source for a transient period of time. The hydraulic/electric power system also includes a first controller configured to operate a first electrical load powered by the first power source and a second controller configured to operate a second electrical load powered, at least in part, by the second power source.

In various embodiments, when the second controller is not operating the second electrical load the electric machine is configured to operate as an electric motor and drive the hydraulic pump in the first direction. The hydraulic pump is configured to charge the accumulator when driven in the first direction.

In various embodiments, the accumulator is configured to discharge and drive the hydraulic pump in the second direction when the second controller is operating. The electric machine is configured to operate as an electric generator when driven by the hydraulic pump operating in the second direction.

In various embodiments, the hydraulic pump is a variable displacement hydraulic (VDH) pump. Depending on the application, the variable displacement pump is an axial piston pump, a radial piston pump, a bent axial piston pump, vane pump, or others.

In various embodiments, the hydraulic pump is a fixed displacement hydraulic pump. Depending on the application, the fixed displacement hydraulic pump is a gear pump, a positive displacement pump, a piston pump, a bent axis piston pump, a vane pump, or others.

In some embodiments, the first power source further incudes a supercapacitor configured to power the second electrical load for a period of time that is less than an on period of time corresponding to a duration of operation in the second direction.

In various embodiments, a high-capacity hydraulic energy source device includes at least one accumulators. Depending on the application, the at least one accumulators may have different energy capacities and/or energy densities.

In various embodiments, an accumulator is a bladder type accumulator. In some embodiments, a bladder type accumulator has a response time of less than about 25 milliseconds and a capacity of between about ¼ gallon and about 15 gallons, inclusive. In some embodiments, an accumulator is a diaphragm type accumulator. In some embodiments, the diaphragm type accumulator has a response time of less than about 25 milliseconds and a capacity of between about ¼ gallon and about 15 gallons, inclusive.

In various embodiments, a supply voltage of a first power source can be maintained at a constant level by a second power source. Depending on the application, a supply voltage of a first power source will be maintained at a constant level of volts direct current (VDC) that is between about 200 volts and about 700 volts, inclusive.

In various embodiments, a second transient load is a transient load with a duty cycle having an off period corresponding to a duration of operation in the first direction and an on period corresponding to the duration of operation of the second direction, the duration of operation of the first period can be greater than the duration of the second period, and can be used to determine, at least in part, the size of the accumulator and, in some applications, also the number or quantity of accumulators.

In some embodiments, the hydraulic/electrical power system further includes a third controller configured to operate a first hydraulic load powered by the hydraulic pump and a fourth controller configured to operate a transient second hydraulic load that cannot be powered by the hydraulic pump alone. Instead, the accumulator is configured to power, at least in part, the transient second hydraulic load. That is, the accumulator is configured to power fluctuations seen on a closed electrical system and/or power fluctuations seen on a closed hydraulic system.

In some embodiments, a method of using accumulator(s) to generate electrical power in a marine environment includes: powering with a first power source a first electrical load controlled by a first controller, configuring an electric machine to operate as an electric motor, driving a hydraulic pump in a first direction with the electric motor, charging an accumulator with the hydraulic pump driven in the first direction by the electric motor, driving the hydraulic pump in a second direction with the discharging accumulator, configuring the electric machine to operate as an electric generator, driving the electric generator with the hydraulic pump driven in the second direction by the discharging accumulator, generating a second power source with the electric generator, and powering with the second power source a second electrical load controlled by a second controller.

In various embodiments, the method of using accumulator(s) to generate electrical power in a marine environment further includes: charging the accumulator until a pressure within the accumulator exceeds a pre-charge pressure and a gas within the accumulators begins to compress and decrease in a volume, in filling the accumulator with a hydraulic fluid to set a minimum fluid level, continuing to charge the accumulator so that the volume of a liquid within the accumulator increases and the gas within the accumulator is further compressed, stopping the charging of the accumulator when the pressure of the gas within the accumulator reaches a maximum pressure, discharging the accumulator to drive the hydraulic pump and generating a second power source with the electric generator driven by the hydraulic pump.

In various embodiments, of the method of using accumulator(s) to generate electrical power in a marine environment further includes generating a second power source with the electric generator, where generating requires a minimum working pressure and a pre-charge pressure of the accumulator is about ⅓ of the maximum operating pressure of the accumulator.

In various embodiments, of the method of using accumulator(s) to generate electrical power in a marine environment requires the pressure in the accumulator to be within a working pressure range, the minimum working pressure is about 1,000 psi, and a maximum working pressure is about 3,000 psi.

In various embodiments of the method of using accumulator(s) to generate electrical power, e.g. in a marine environment, the second electrical load has an intermittent power requirement that cannot be meet by the first power source alone. Therefore, the constant current drawn by the electric motor driving the hydraulic pump that charges the accumulator is less than a peak current drawn by the second load, which is a transient current. The output power of the first power source is maintained at a constant level by the second power source.

In various embodiments of the method of using accumulator(s) to generate electrical power, e.g. in a marine environment, the duration of the motor current during the charging of the accumulator is greater than the duration of the peak current drawn by the second load.

In various embodiments of the method of using accumulator(s) to generate electrical power, e.g. in a marine environment, the accumulator can be charged with a remote gas bottle, which is filled with dry nitrogen gas.

In some embodiments of the method of using accumulator(s) to generate electrical power, e.g. in a marine environment, the method includes: configuring an electric machine to operate as an electric motor; driving a hydraulic pump in a first direction with the electric motor (where the electric motor is powered by a constant electrical power source); charging an accumulator with the hydraulic pump driven in the first direction by the electric motor; configuring the accumulator to drive at least one hydraulic load and/or electrical load (the hydraulic load can be a transient hydraulic load, the electrical load can be a transient electrical load; configuring the accumulator to drive the electrical load can include driving the hydraulic pump in a second direction using the discharging accumulator; driving the electric machine configured to operate as an electric generator can be performed using the hydraulic pump; generating a second power source with the electric generator; powering with the second controller the second power source; controlling the electrical load using the second controller powered by the second power source; and maintaining the power drawn from the output of a first power source at a constant level.

In various embodiments, the method of using accumulator(s) to generate electrical power in a marine environment further includes: configuring the electric machine to operate as an electric motor that is powered by a constant electric power source, driving the hydraulic pump in a first direction with the electric motor and charging the accumulator with the hydraulic pump driven in the first direction by the electric motor in the time period between the hydraulic transient load and the transient electrical load, and vice versa.

In some embodiments, the hydraulic/electrical power system is specifically adapted to marine hydraulic systems such as those deployed in large sailing and seafaring vessels.

While the hydraulic/electrical power system described herein was originally conceived to address the unresolved issues found in the closed electrical systems of the marine industry, the proposed hydraulic/electric power system can be expanded and adapted to any closed electrical system having a hydraulic system.

In some embodiments, the hydraulic/electrical power system is adapted to hydraulic systems powered by generator power sources such as those deployed for construction equipment power systems, emergency power back-up power systems, aviation systems, and/or others.

Among the many benefits to its users, the hydraulic/electrical power systems described herein greatly reduce power fluctuations in the electric system. The system also provides electronic power limiting, allowing the use of more common fixed displacement and variable displacement hydraulic pumps. The system allows for reducing a total volume of hydraulic fluid accumulation.

In some embodiments, the hydraulic/electric power systems described herein are adaptable for use in or with systems that requires a constant load draw from an available power source, where the hydraulic system fluctuates causing the power source to act in a negative behavior, such as, but not limited to, voltage drops, frequency drops, or current spikes.

In some embodiments of the hydraulic/electric power systems described herein, hydraulic fluid from an accumulator is released into the hydraulic portion of the hydraulic/electric power system in response to an input or command from a user. For example, hydraulic fluid from an accumulator can be released into centering cylinders, hydraulic lock cylinders, and/or any type of hydraulic device that requires hydraulic fluid on an intermittent basis as per an operator user's instruction.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

INCORPORATION BY REFERENCE

All publications, patents, and patent applications mentioned in this specification are herein incorporated by reference to the same extent as if each individual publication, patent, or patent application was specifically and individually indicated to be incorporated by reference, including U.S. patent application Ser. No. 16/925,487, titled "Hydraulic Charging System with Electronic Power Limiting and Load Balancing" and filed on Jul. 10, 2020.

BRIEF DESCRIPTION OF THE DRAWINGS

The features and advantages of the present disclosure will be more fully described in, or rendered obvious by, the following detailed description of the preferred embodiments, which are to be considered together with the accompanying drawings, wherein like numbers refer to like parts and further, wherein.

Figure 1:
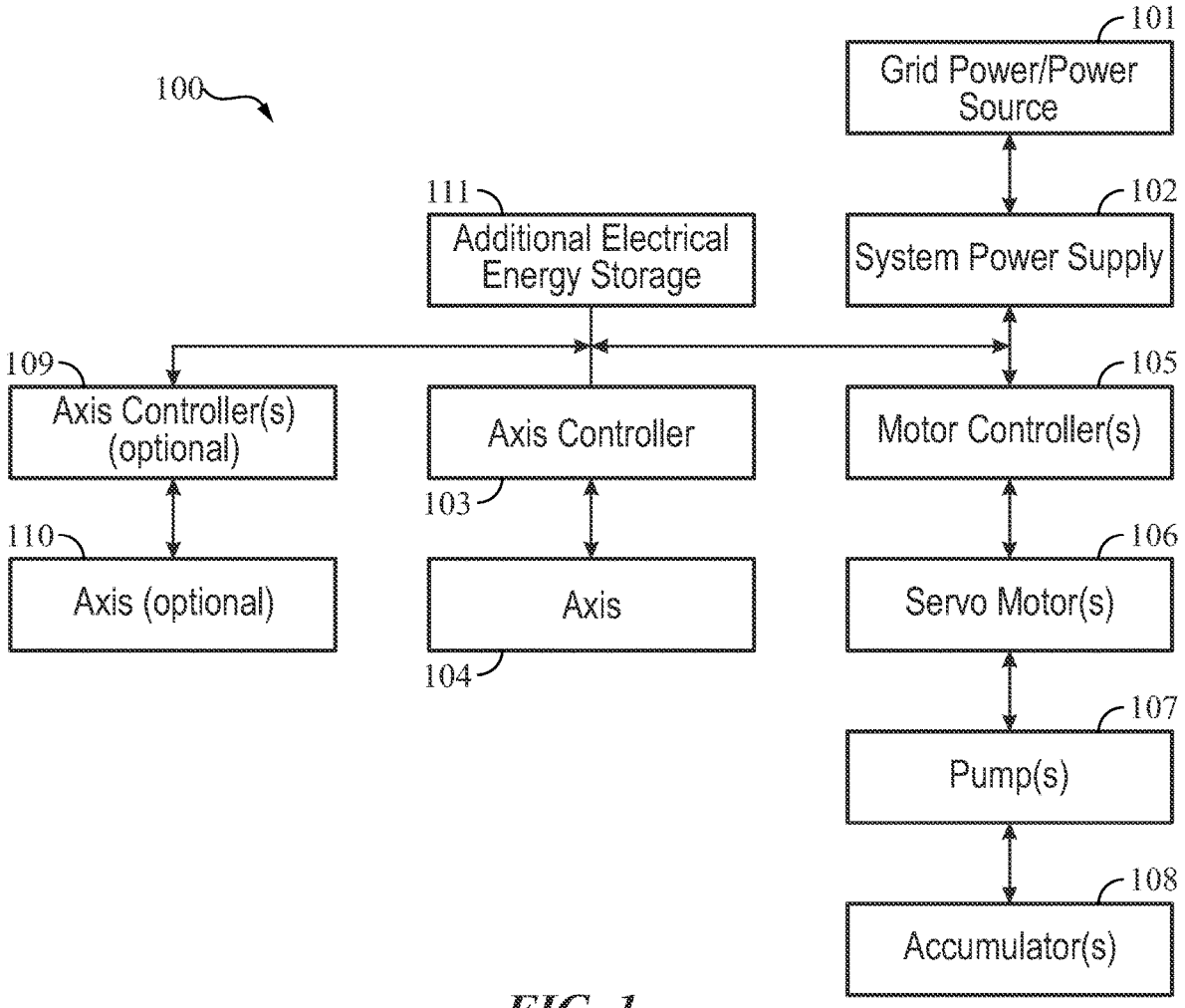
FIG. 1 is a block diagram of a hydraulic/electric power system, in accordance with some embodiments.

The foregoing and other features of the present disclosure will become apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF THE INVENTION

Reference will now be made in detail to the present preferred embodiment(s), examples of which is/are illustrated in the accompanying drawings. Whenever possible, the same reference numerals will be used throughout the drawings to refer to the same or like parts.

One of the most vexing problems for marine sailors is how to keep the battery(s) topped up without resorting to running the engine while supplying high energy transient loads without causing brownouts or overloading the electrical power system and causing it to shut down. In the past, electricity usage might have meant using a few amps for a radio, GPS, cockpit lights, navigation lights, and the like. However, modern marine vessels are much more energy intensive and burn through hundreds of amp-hours of battery capacity each day and generate significant peak currents with transient loads. A modern marine vessel may have live-well pumps to circulate water and keep marine life alive on board, freshwater pumps, spreader lights, trim tabs, ac units, refrigeration units, supplicated navigation systems with radar, sonar, and the like, many of which create large transient loads which can pull the system voltage down and cause "brownouts".

A brownout is an intentional or unintentional drop in voltage in an electrical power supply. Intentional brownouts are tactically used for load reduction in emergency situations. The term brownout derives from the dimming of incandescent lighting when applied voltage is reduced. A brownout can also be unintentionally caused by high electricity demand that is near or above a power generating utility's production capacity. When this occurs, the power generating utility may reduce the flow of electricity to certain areas of the electrical system to prevent a blackout, which is categorized as a large-scale electrical service interruption.

Hydraulic systems are utilized all over the world for a multitude of applications. Hydraulic systems, and, in particular, marine hydraulic systems, are complex and require routine maintenance in order to perform in top working order. Most modern large sailing and seafaring vessels utilize hydraulic systems to perform or assist with the functions of many, if not most, critical systems on board. Often a single hydraulic system is used in multiple systems that function simultaneously, causing high cyclic loading and thus high wear on the various electrical and mechanical components of the hydraulic system, as well as the chemical integrity of the hydraulic fluids.

Conventional hydraulic servo systems store energy by compressing a gas for future use in a hydraulic accumulator, which is similar or analogous to an electric circuit storing energy in a battery for future use. However, existing hydraulic accumulator designs do not allow for the high energy density needed for many extended use applications, which would require large, heavy, and, in some cases, multiple accumulators. These hydraulic accumulator designs are well suited to handling high transient peak loads. A typical hydraulic servo system uses a servo motor for steady state situations and an accumulator to handle the transient peak hydraulic loads.

In contrast to these conventional hydraulic servo systems, the purposed hydraulic/electric power systems described herein can use a generator, i.e. a high-energy primary storage device, to meet the extended use electrical requirements. These power systems can also use a hydraulic accumulator configured to generate electrical energy, i.e. a high-capacity auxiliary energy storage device, to handle the transient peak electrical loads. In various embodiments, the high-energy primary storage device can be an electrical battery or the like. The purposed hydraulic/electric solution can meet both the long-term energy efficiency requirements and the peak transient energy needs of a closed marine electrical system. The dual criteria of energy-efficiency and energy-density have led to the use of hydro-pneumatic conversion systems.

While the proposed hydraulic/electric power systems are specifically adapted to marine hydraulic systems such as those deployed for large sailing and seafaring vessels, in various embodiments the hydraulic/electric power system can be adapted to many other hydraulic/electric power systems powered by generator power sources. In various embodiments, these hydraulic/electric power systems are adapted to construction equipment power systems, emergency power back-up systems, aviation systems, or others. In some embodiments, the hydraulic/electric power system is adaptable for any system that requires a constant load draw from the available power source, where the hydraulic system fluctuates causing the power source to act with an undesired or negative behavior, such as, but not limited to, voltage drops, frequency drops, or current spikes.

The idea of associating a high-capacity energy storage medium (accumulator 108), and a high-density energy storage device (battery), is implemented in the context of an off-grid power system whose components are shown in FIG. 1. All the components of the high-capacity energy storage medium are reversible. During the storage process, an electric machine 106 works as a motor and drives the hydraulic pump 107, which operates as a pump to fill the accumulator 108 with pressurized hydraulic oil. During the generation process, the compressed air is used to drive the pressurized hydraulic oil into the hydraulic pump 107 in reverse, which operates as a motor to drive the electric machine 106 which now operates as a generator to generate electrical power for the hydraulic/electric power system 100. In various embodiments, the hydraulic/electric power system 100 utilizes an efficiency algorithm to maintain the accumulator and/or hydraulic pump 107 at a maximum efficiency operating point when the system is operating as an energy storage device.

Turning now to FIG. 1, in various embodiments, a hydraulic/electric power system 100 comprises local and distributed energy storage devices. While a high-density storage device with its lighter cable runs can be located physically remote or at a distance away from the energy supply in some embodiments, an accumulator 108 (such as a high-capacity storage device) can be physically located near a transit load to avoid heavy cable runs.

As shown in FIG. 1 a hydraulic/electric power system 100 used to power transient axis loads comprises a power source. The power source can be a utility grid power supply 101, a generator including backup generator(s), or another source of electricity. The hydraulic/electric power system 100 can also comprise a system power supply 102 or modular power supply, which can be a device that takes Alternating Current (AC) power and converts the AC power to Direct Current (DC) power, or vice versa. The hydraulic/electric power system 100 can also include a motor controller 105 and an axis controller 103, In various embodiments, the hydraulic/electric power system 100 may further comprise additional motor controllers 105 and axis controllers 109 (optional), which, depending on the application, can be optional. The motor controller 105 and axis controllers 109 can be inverters that convert the DC voltage into an AC voltage. In various embodiments, the motor controllers 105, and axis controllers 103 and 109 can convert the DC voltage back into an AC voltage of varying frequency which is used to adjust the Revolutions per Minute (RPM) or motion of a servo motor(s) and axis load(s) 104 and 110 causing the servo motor(s) and/or axis load(s) 104 and 110 to move at a designated speed and perform work.

The hydraulic/electric power system 100 can also comprise an accumulator 108. An accumulator 108 in a conventional hydraulic servo system can store hydraulic energy much like a car battery stores electrical energy. The accumulator 108 can be a pressure vessel containing a membrane or piston that defines separate subchambers within a chamber and confines and compresses an inert gas, which is normally nitrogen, on one side of the membrane, in one subchamber. Hydraulic fluid can be held on the other side of the membrane in a separate subchamber. In a conventional hydraulic servo system, an accumulator 108 can store hydraulic fluid under pressure to supplement pump flow and reduce pump capacity requirements. Accumulator 108 can also provide auxiliary hydraulic power in an emergency (e.g. using stored energy, centering cylinders can be extended or a lock pin can engage, preventing the system from unwanted movement while main power is off). In a closed hydraulic servo system, accumulator 108 can prevent pressure fluctuations by maintaining hydraulic pressure and absorbing hydraulic shocks, surges, and pulses, caused by rapid operation or sudden starting and stopping of hydraulic devices. This functionality can be analogous to that of an air dome used in pulsating piston or rotary pumps. It should be understood that accumulator 108 can be many different sizes, shapes, and designs in different embodiments, so long as it operates to store hydraulic fluid under pressure.

Embodiments herein contemplate the use of at least four types of accumulators 108: a diaphragm (or bladder) type, a hydro-pneumatic piston type, a spring type, a weight-loaded piston type, and others. The weight-loaded piston type was historically the first developed and is typically much larger and heavier for its available capacity than more modern hydro-pneumatic piston and bladder types. As such, the weight-loaded piston type is seldom used in the modern day, although modifications or advancements could create new and different applications. The spring type is also infrequently used in modern applications. Of the other two types, the hydro-pneumatic piston type accumulator and the diaphragm type, the hydro-pneumatic accumulator is the type most used today. The diaphragm type accumulator is more responsive that the hydro-pneumatic piston type and is a better suited to systems needing a response time that is less than about 25 milliseconds. The less responsive hydro-pneumatic piston type is better suited to systems having a response time that is greater than about 25 milliseconds. The flow rates of the diaphragm type accumulator and the hydro-pneumatic piston type is between about 200 gallons per minute (gpm) and 600 gallons per minute (gpm). The maximum capacity of the diaphragm type accumulator is lower than hydro-pneumatic piston type, being about 40 gallons. The capacity of the hydro-pneumatic piston type can be over 40 gallons with maximum capacity for a single vessel being about 200 gallons. In various embodiments, the capacity of the accumulator 108 is between about ¼ gallon and about 15 gallons. In some embodiments, the capacity of the accumulator 108 is about 10 gallons.

With a conventional hydraulic system, the accumulator allows the system to use a smaller pump because accumulator 108 stores hydraulic energy from the pump during periods of low demand. This hydraulic energy is available for instantaneous use, released upon demand at a rate many times greater than what could be supplied by the small pump alone. For example, in a hydraulic system configured to operate a cylinder, where the dwell time is about 45 seconds out of a second cycle the system can use an accumulator(s) 108 to reduce the size of a fixed-volume pump. The hydraulic system's 25-gpm fixed volume pump driven by a 25 hp motor operates on pressure during most of the 60 sec cycle to fill the cylinder and accumulator 108. The accumulator 108 is used to operate the cylinder for about 15 seconds out of the 60 second cycle time. Without the accumulator 108, the hydraulic system would require a 100-gpm pump driven by a 100 hp motor. Even in the unlikely event that the cost for a smaller pump/motor and accumulator 108 was close to that of the larger pump and motor, the energy savings over the systems life makes the accumulator 108 circuit the more cost effect option. When used in place of a traditional hydraulic system without an accumulator 108 the efficiencies are greatly improved. For example, the efficiency of the system may be improved by over about 80%. In some cases, the efficiency of the system may be improved by up to 84%.

In some embodiments, an accumulator 108 is installed in a hydraulic system when the duty cycle is less than a certain value. For example, an accumulator 108 may be installed in a hydraulic system when the duty cycle is less than about 50%.

In various embodiments, the hydraulic/electric power system 100 comprises more than one accumulator 108. For example, multiple accumulators 108 are needed to meet the high-capacity or energy requirements of the system. In some embodiments, several accumulators 108 are mounted on or otherwise coupled to a common hydraulic manifold.

Similar or analogous to how a hydraulic system can use a smaller motor with an accumulator 108 to supplement pump flow, a hydraulic/electric power system 100 can use a smaller electric generator with an accumulator 108 to supplement electricity usage. For example, in a hydraulic/electric power system 100 configured to power a transient electrical device, where the dwell time is about 55 seconds out of a 60 second cycle, the system can use an accumulator 108(*s*) to reduce the size of an electrical generator and/or battery bank. The hydraulic/electric power system 100's 1000 W generator can operate during most of the 60 second cycle to drive a hydraulic pump 107 to fill accumulator 108 and satisfy the continuous electrical load requirements. In some embodiments, the 1000 W generator will also trickle charge the battery bank. Accumulator 108 can be used to power the transient electrical load for about 6 seconds out of the 60 second cycle time, or about ten percent of the cycle time. Assuming that the continuous power requirement is about 300 W, hydraulic/electric power system 100 with the accumulator 108 would require a generator of about 8-kW to meet the power transient over the about 6 seconds. Even in the unlikely event that the cost for a smaller generator/motor and accumulator 108 is close to that of the larger generator and motor, the energy savings over the system's life makes accumulator 108 a more cost effect option. The energy storage efficiency of a hydraulic/electric power system 100 that stores hydraulic energy in an accumulator 108 to be converted into electric energy to power transient electrical loads is greater than about 80%. Even in a hydraulic/electric power system 100 with very high-power cycles rates, where the accumulator(s) 108 is fully charged and discharged on the order of seconds, the energy storage efficiency of a hydraulic/electric power system 100 that is well designed can be up to about 89%. Further, accumulator(s) 108 when used correctly increase the hydraulic/electric power system 100 performance and efficiency, lower maintenance costs, provide fail-safe protection, and extend system life by minimizing failure of pumps 107, pipes, and other limited life components.

In some embodiments, the size of accumulator 108 and/or number of accumulators 108 is based, at least in part, on the dwell time. In various embodiments, the size of accumulator 108 and/or number of accumulates is based, at least in part, on the duty cycle of the transient load. That is, the time occupied by the cycle of operation of a device, expressed as a percentage of available time. In some embodiments, an accumulator 108 can be installed when the duty cycle is less than a certain value. For example, an accumulator 108 may be installed when the duty cycle is less than about 95%.

The electric machine(s) 106 (servo motor) can be thought of as the muscle of the hydraulic/electric power system 100 and is available in a variety of technologies, including brush or brushless, housed or frameless, linear or rotary. The electric machine 106 (servo motor) produces the torque required to accelerate and move the load. The motor controller 105 and optional motor controller(s) 109 can be thought of as the brain of the electric power system. In various embodiments, the motor controller 105 and optional motor controller(s) 109 are Direct Current (DC) to Alternating Current (AC) devices. A basic motor controller 105 and optional axis controller(s) 109 may control only torque and/or speed, while a more sophisticated axis controller 105/109 may be configured as a positioner and have programming capabilities. The axis controller 105/109 can be matched to the electric machine 106 (servo motor) and control the voltage and current that the electric machine 106 (servo motor) receives. In various embodiments, servo motor(s) 106 comprises a feedback control component. The feedback component can consist of an encoder, resolver, linear feedback device, tachometer, vision system, and/or the like.

In some embodiments, an electric machine can be a servo motor 106, which can be a variable RPM motor, that drives a hydraulic pump(s) 107. In various embodiments, the hydraulic pump 107 and the electric machine 106 (servo motor) are combined into a single device, structure, or system. As such, hydraulic pump 107 can be any type of hydraulic pump 107 or electric machine 106 (electric motor) that can perform both functions of pumping and acting as motor. In some embodiments, the hydraulic pump 107 is a reversable hydraulic pump 107. Hydraulic pump 107 can push hydraulic oil or any incompressible hydraulic fluid that is petroleum-based, water-based, or synthetic based into an accumulator 108 to store hydraulic energy or be driven by hydraulic oil pushed into the hydraulic pump 107 by accumulator 108. In some embodiments, hydraulic pump 107 can be any fluid transfer device that can convert physical motion into hydraulic flow and pressure, or vice versa. Accumulator 108 can be any pressure storage reservoir in which an incompressible hydraulic fluid is held under pressure that is applied by an external source of mechanical energy. An external source of mechanical energy can be a hydraulic pump 107, compressed air, raised weight, spring, and the like.

In various embodiments, accumulator 108 can be a bladder type accumulator, piston type, or similar type device, as described previously herein. The size of accumulator 108 and/or number of accumulators 108 can vary depending on the application. In some applications accumulator 108 is a bladder type accumulator and the size of accumulator 108 can be between about ¼ gallons and about 15 gallons, or more.

In some embodiments, axis loads 104 or 110 or electrical loads can be, but are not limited to, any device that converts electrical energy into motion. For example, axis loads 104 and/or 110 can be servo motors, linear motors, torque motors, or others. In some embodiments, hydraulic/electric power system 100 further comprises an additional electrical energy storage device 111. Additional energy electrical storage device 111 can be any additional DC electrical power storage device that is designed to store extra electrical energy in the hydraulic/electric power system 100. For example, additional electrical energy storage device 111 can be, but is not limited to, batteries, capacitors, supercapacitors, or combinations thereof.

The proposed hydraulic/electric power system 100 can be used in any application where there an intermittent power demand and a requirement to draw only a fixed or limited amount of power from the utility grid power supply 101 or storage device that is less than the intermittent power demand.

In some embodiments, hydraulic/electric power system 100 comprises of at least one accumulator 108, at least one hydraulic pump 107, and at least one electric machine 106 (servo motor or other variable RPM motor), and/or at least one motor controller 105. In various embodiments, hydraulic/electric power system 100 includes other devices, such as, but not limited to, check valves, pressure sensors, relief valves, directional valves, heat exchangers, filters, and other hydraulic control and monitoring components. Hydraulic/electric power system 100 also includes, connected via the motor control, at least one additional "axis" for control, this can be, but not limited to, linear servo motors, rotary servo motors (or other variable RPM motors), torque motors, or any other type of device that will consume energy in an intermittent fashion. These other types of devices may be connected to or used to drive such components as hydraulic pumps 107, conveyor belts, position control appanages, wheels, other motion control devices, and the like.

As used herein, accumulator 108 can be a pressure storage reservoir in which a non-compressible hydraulic fluid is held under pressure that is applied by an external source of mechanical energy. Accumulator 108 can be a type of energy storage device. A conventional accumulator enables a hydraulic system to cope with extremes of demand, often using a less powerful pump, to respond more quickly to a temporary demand, and to smooth out pulsations, often resembling knocking heard in some systems. Further, as used herein, the term "accumulation" refers to a volume of non-compressible hydraulic fluid stored under pressure.

In various embodiments, electric machine 106 (servo motor) can be a variable Revolutions per Minute (RPM) electric machine 106 that can be configured in real time to operate as either an electric motor or as an electric generator. In some embodiments, the hydroelectric/system comprises a dedicated electric motor and a separate dedicated electric generator, where each device is optimized to perform only one function.

In some embodiments, when the one or more of axis controllers 103 is not operating axis load 104, or axis controller 109 is not operating axis load 110, the motor controller 105 will be commanded to increase the pressure in accumulator 108 using electric machine 106 (servo motor) and hydraulic pump 107. The pressure in accumulator 108 will be allowed to increase until the pressure in accumulator 108 reaches a maximum allowable pressure or the one or more axis(es) loads 104/110 that was not operating now requires energy to operate, whereupon motor controller 105 will be command to stop increasing the pressure in accumulator 108. At this point, hydraulic energy stored in accumulator 108 will be used to operate hydraulic pump 107, which drives electric machine 106 (servo motor), which in turn generates electrical energy that is now available to axis controllers 103 and 109 to now operate the one or more axis(es) loads 104 and 110. Operating one or axis(es) loads 104 and 110 will cause the pressure in accumulator 108 to decrease. Because hydraulic/electric power system 100 comprises only electrical and hydraulic components, hydraulic/electric power system 100 can respond in substantially real time to transient power demands. In some embodiments, hydraulic oil may be preheated to lower the viscosity of the oil and thereby improve the response time of hydraulic/electric power system 100. In various embodiments where the transient power demand is predictable and there is a lag because of the inertia of large components, response time of valves, and the like, hydraulic/electric power system 100 will start hydraulic pump 107 prior to the transient demand. In some embodiments where the transient power demand is not predictable and there is a lag, a small capacitor or the like provides power only for the duration of the lag.

In various embodiments, the charging rate of accumulator 108 is based, at least in part, on the power required by the one or more axis(es) loads 104 and 110 that is/are not operating, or vice versa. In some embodiments, the charging rate of accumulator 108 is constant irrespective of whether more than one of axis 103 and axis 110 requires power to operate.

In various embodiments, one or more of the axis(/es) loads 104 and 110 is an actuator that is a part of a device that performs physical movements by converting energy, air (pneumatic), electrical, or hydraulic into a mechanical force. The actuator can be one or more, or a combination of: a rotary actuator, linear actuator, hydraulic actuator, pneumatic actuator, electric actuator, thermal actuator, thermal actuator, magnetic actuator, mechanical actuator, piezoelectric actuator, and the like. In some embodiments, the actuator is an electric servo motor. A servo motor is a rotary actuator that is designed for precision control, The servo motor generally comprises a Direct Current (DC) motor, a control circuits, and a position sensor or form part of a servo system comprising a motor controller 105, electric machine 106 (electric motor), and a feedback device built into the servo motor.

In some embodiments, the hydraulic/electric power system 100 is a closed electrical system. The closed electrical system is a stand-alone power system (SAPS), also known as remote area power supply (RAPS). In various embodiments, the hydraulic/electric power system 100 is an off-the-grid electrical system for locations that are not fitted with an electricity distribution system (SAPS).

In some embodiments, a closed electrical system includes one or more methods of electricity generation, energy storage, and regulation. In a conventional closed electrical system, a battery bank may be used but this may be impractical for larger applications. Power drawn directly from the battery bank will be direct current DC low voltage that can be used for DC lighting and DC appliances. An inverter is used to generate AC, which is used for conventional AC appliances.

In some embodiments, a method of electricity generation and charging of the battery bank includes renewable energy source(s). For example, solar charging with solar panels, wind charging with a wind turbine, water charging with a hydro-generator dragged through the water behind the boat or attached to a shaft, or others. However, these methods are dependent on the appropriate conditions, such as weather. To elaborate, solar panels reach their stated output for only a few hours per day, when angled into the sun. In the case of water charging, the vessel is required to be under way or located in a suitable tidal current. Further, the capacity of these methods is insufficient for most applications, and they are susceptible to damage. In the case of water charging, these methods create additional drag.

In some embodiments, the battery bank may be fast charged by an alternator driven by a marine engine. However, this can use almost as much fuel as when motoring. In theory, the peak power surges could also be supplied by an alternator driven by the marine engine. In practice, running the marine engine intermittently for power surges can harm the marine engine, as the marine engine is not designed to run below its rated level. Further, the response time of an alternator driven by a marine engine is inadequate for most applications.

In various embodiments, the method of electricity generation and charging of the battery includes an auxiliary generator driven by a combustion engine. However, this method is noisy, is not environmentally friendly, and again the response time of an alternator driven by a marine engine is not good enough for most applications requiring the generator to be idling under a light load.

In some embodiments, the battery(s) is a deep discharge marine battery with heavier plates and a construction designed to withstand vibration and pounding, and wherein the deep discharge marine battery is a Lithium-ion battery, absorbed glass mat (AGM), gel cell, wet cell (flooded), sealed lead acid battery, open lead acid battery, or the like.

In some embodiments, the battery bank is entirely replaced by an accumulator 108 coupled to a hydraulic pump 107 driving an electric machine 106 (electric generator). In various embodiments, the accumulator 108 supplements the battery bank by handling high cycle transient electrical loads.

The cycle life of a battery is the number of charge batteries cycles that a battery can complete before losing performance, The cycle life of a battery is affected significantly by the Depth of Discharge (DOD). For example, the cycle life may be defined as the number of cycles with a 100% DOD a battery can perform before the capacity of the battery drops to 80% of the battery's original capacity, as which point a reduce in performance of the battery begins to become visible. The cycle life of a deep discharge battery is between about 200 and about 2000 cycles or between about 1 and about 6 years if used correctly. That is, not overcharge, undercharge, under discharge, less than 10% of DOD, or over discharge greater than about 50% of DOD.

In some embodiments, the battery bank is supplement by the proposed configuration of accumulator 108, hydraulic pump 107, and electric machine 106 (electric generator). The electricity generated by the accumulator 108 is used to increase the cycle life of deep discharge battery(s). In some embodiments, the accumulator 108 will be configured to generate electric only after the DOD is greater than a minimum value. For example, the DOD being greater than about 10%. In various embodiments, the capacity of the accumulator 108 is based upon, at least in part, preventing the DOD exceeding a maximum DOD value. For example, the DOD being less than about 50%. In various embodiments, the hydraulic/electric power system 100 is configured so the accumulator 108 maintains the battery DOD between a range. For example, between about 20% DOD and about 40% DOD. In some embodiments, the battery bank is replaced by the proposed configuration of accumulator 108, hydraulic pump 107, and electric machine 106 (electric generator). By using an accumulator 108, components with a finite life can be replaced, reduced, or the finite life of these components can be extended. These finite life components include the battery(s), capacitor(s), supercapacitor(s), and other energy storage devices. Further, by using an accumulator 108 there can also be a reduction of the infrastructure needed to supply power to the vessel. For example, a higher America Wire Gauge (AWG) and therefore a smaller diameter wire can be used.

In some embodiments, the battery bank is replaced or supplemented by a methanal or hydrogen fuel cell. In various embodiments, the battery bank is replaced or supplemented by a capacitor or supercapacitor energy storage device comprising one or more supercapacitors. Supercapacitors are energy storage devices that bridge the gap between batteries and conventional capacitors. Supercapacitors can store more energy than capacitors and supply it at higher power outputs than batteries, because of the supercapacitor's low series resistance. In addition to the supercapacitors rapid charge and discharge characteristics the supercapacitor can operate for 10 years or more with only about a 20% lost in capacity. However, while a supercapacitor can store more energy than a capacitor the energy density of a supercapacitor is still only about 5 Wh/kg, whereas the energy density of Li-ion batteries is between about 100 Wh/kg and about 200 Wh/kg, meaning that a supercapacitor would weight about 20 times as much as Li-ion battery of equivalent capacity.

The hydraulic/electric power system 100 needs a working pressure to perform the work. In some embodiments, the working pressure may be a pressure range. In some embodiments, the accumulator 108 is initially filled to a pre-charge pressure that is lower than the minimum working pressure so that the accumulator 108 can filled with pressurized oil. For example, the accumulator 108 may be initially filled to a pre-charge pressure of 1000 psi while the minimum working pressure to perform the work, cycle a cylinder and the like, is 2000 psi. In some embodiments, the accumulator 108 is filled to a pressure that is greater than the minimum working pressure, the maximum working pressure, so that the accumulator 108 can supply fluid without dropping below the systems minimum working pressure. For example, the accumulator 108 may be charged to a maximum working pressure of 3000 psi. Filling the accumulator 108 to 3,000 psi ensures that the accumulator 108 can supply hydraulic fluid, the force, to cycle the cylinder in the allotted time without dropping below the minimum working pressure of 2,000 psi.

In some embodiments, extra energy in the system is pushed back onto the utility grid power supply 101. For example, where the accumulator 108 of the hydraulic/electric power system 100 is located on a marine vessel with intermittent access to a utility power grid supply 101 or the like. Not only is this environmentally conscious, especially when the accumulator 108 has been charged using one or more renewable energy sources, but it is the financially astute action where net metering or the like is available. In net metering the utility grid power grid 101 company either pays for the excess power that is transferred onto the utility grid power supply 101 or offsets the transferred power from the cost of electricity drawn from the utility grid power supply 101 at other times.

In some embodiments, the hydraulic/electric power system 100 is a fixed-volume system. In various embodiments, the fixed-volume system further comprises flow control and a pressure switch. Adding flow control and a pressure switch allows the system to unload pressure when the pressure in the system is at or above the pressure switch's maximum setting. If leaks occur in the system, for instance at values or system seals, and the pressure is at or below the pressure switch's minimum setting the pressure switch allows the system to pressurize the accumulator 108 until the pressure in the system is back at its maximum level.

In various embodiments, the hydraulic pump 107 is a fixed displacement hydraulic pump 107, a device that converts mechanical energy to hydraulic (fluid) energy. Depending on the application, the fixed displacement hydraulic pump is a gear pump, a positive displacement pump, a piston pump, a bent axis piston pump, a vane pump, or the like. The displacement, or amount or fluid pumped per revolution of the pump's input is fixed and cannot be varied while the hydraulic pump 107 is running. Many fixed displacement pumps 107 are "reversible", meaning that they can act as a hydraulic motor and convert hydraulic fluid energy into mechanical rotational energy, which is converted into electrical energy in the case of a generator. In some embodiments, the hydraulic pump 107 is a variable displacement hydraulic pump 107 a device that converts mechanical energy to hydraulic (fluid) energy. The displacement, or amount or fluid pumped per revolution of the pump's input can be varied while the hydraulic pump 107 is running. Many variable displacement pumps 107 are "reversible", meaning that they can act as a hydraulic motor and convert hydraulic fluid energy into mechanical rotational energy, which is converted into electrical energy in the case of a generator. The flow rate and output pressure of the variable displacement hydraulic pump 107 can be changed during the operations. The valves that control the speed of the actuators control the speed of the fluid flow rate.

The hydraulic/electric power system 100 can be comprised of at least one accumulator 108, at least one hydraulic pump 107, at least one electric machine 106 (servo motor or other variable RPM motors), at least one motor controller 103 and axis(es) controller 105, and 109. It may include additional components such as check valves, pressure sensors, relief valves, directional valves, heat exchangers, filters and other hydraulic control and monitoring components. It can also include, connected via the motor controller 105, at least one additional "axis" load 104, 110 for control, this can be, but not limited to, linear servo motors, servo motors (or other variable RPM motors), torque motors, or any other device that will consume energy in an intermittent fashion. Such devices may be connected to or used to drive such components as hydraulic pumps 107, conveyor belts, position control appanages, wheels, or other motion control devices.

In various embodiments, the motor controller 105 and axis controllers 103 and 109 are inverters. The axes controllers 103, 105, and 109 convert a Direct Current (DC) voltage into an Alternating Current (AC), which can be used to power electrical equipment rated for AC mains voltage. In some embodiments, one or more of the axis controllers 103, 105, and 109 is used to produce a pulse width modulation at a fixed frequency for various motor(s). Pulse Width Modulation (PWM) speed control works by driving the motor with a series of "ON-OFF" pulses and varying the duty cycle, the fraction of the time that the output voltage is "ON" compared to when the output voltage is "OFF", of the pulses while keeping the frequency constant. In various embodiments, the axis loads 104/110 is an actuator.

In some embodiments, motor control is used with a feedback device. When an axis controller 103, 105, or 109 sends a signal to the actuator to move to a specific position, the actuator starts to move, and the feedback device signals back to the respective axis controller 103, 105, or 109 telling the respective axis controller 103, 105, and 109 where and how fast the actuator is moving. The axis controller 103, 105, and 109 then reviews the feedback and determines if the actuator has reached the commanded position. If not, the control device will continue to signal the actuator to move until the axis controller 103, 105, and 109 receives a signal from the feedback device that the actuator has reached the desired position.

In various embodiments, PWM is used to adjust the RPM/motion of one or more of the electric machines 106 (servo motors), and axes loads 104 and 110 causing one or more of the servo motors 106 and axes loads 104 and 110 to move at a designated speed to perform work. In some embodiments, the speed of the electric machine 106 (servo motor) and axes loads 104 and 110 can be controlled by one or more of the axis controllers 103, 105, and 109 modifying the supply frequency.

In some embodiments, the electric machine 106 (servo motor) can be configured to drive the one or more hydraulic pump(s) 107. The electric machine 106 (servo motor) can be a variable drive RPM motor or any type of motor that capable of driving the hydraulic pump(s) 107. In various embodiments, the electric machine 106 is configured as a motor that drives the hydraulic pump(s) 107, which is configured to pump oil into the accumulator 108 to store hydraulic power. In some embodiments, the electric machine 106 can also be configured as a generator that produces electrical power when driven by the hydraulic pump 107 which is configured to receive hydraulic oil under pressure from the accumulator 108. In various embodiments, the electric machine 106 and hydraulic pump 107 is single device that can perform both functions. That is, the single device can push hydraulic oil into the accumulator 108 to store hydraulic power and generate electricity when receiving hydraulic oil from the accumulator 108. In various embodiments, the hydraulic pump 107 can be any fluid transfer device that can convert physical motion into hydraulic flow and pressure and vice versa.

While the hydraulic/electric power system 100 has been described in the context of the marine industry where a transient load on a closed electrical system can pull down the supply voltage of the vessel the application the features and advantage of the hydraulic/electric power system 100 are not restricted to only a marine application. The proposed hydraulic/electric power system 100 can be expanded to any system that requires energy storage while using servo motors/drives or the like or other devices that generate transient loads. For example, the axis or load 104 and 110 can be any device that converts electrical energy into motion, such as but not limited to servo motors, linear motors, torque motors, permanent magnet machines, induction machines, synchronous reluctance machines, reluctance synchronous machines and the like or any device that creates a transient load.

Figure 2:
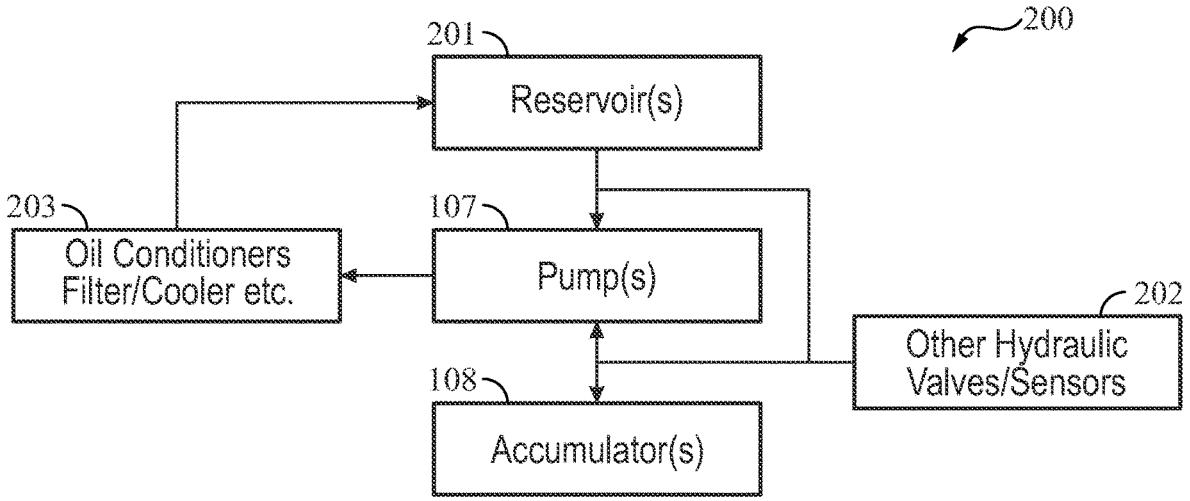
FIG. 2 is a more detailed block diagram of the hydraulic portion of the hydraulic/electric power system of FIG. 1, in accordance with some embodiments.

As shown in FIG. 2, in some embodiments a hydraulic portion 200 can be part of a hydraulic/electric power system 100 (e.g. as shown and described with respect to FIG. 1). Hydraulic portion 200 can further comprise a hydraulic oil reservoir 201, hydraulic oil conditioners 203*a*, hydraulic oil filters 203*b*, coolers 203*c*, and the like, and other hydraulic valves and sensors 202, and the like. In various embodiments, one or more of the hydraulic oil reservoirs 201, hydraulic oil conditioners 203*a*, hydraulic filters, 203*b*, coolers, 203*c*, and the like are combined into a single device. In some embodiments, one or more of the hydraulic oil reservoirs 201, hydraulic oil conditioners 203*a*, hydraulic oil filters 203*b*, and hydraulic conditioner 203*c* can be shared with an existing hydraulic system. In various embodiments, one or more of the one or more of the hydraulic oil reservoirs 201, hydraulic oil conditioners 203*a*, hydraulic oil filters 203*b*, and hydraulic conditioner 203*c* is dedicated to only the hydraulic portion of the hydraulic/electric power system 100. FIG. 2 also illustrates various hydraulic connections and the direction of flow between the accumulator 108, hydraulic oil reservoir 201, hydraulic pump 107, hydraulic oil conditioners, filters, cooler, and the like, and other hydraulic valves and sensors 202 of the hydraulic portion 200 of the hydraulic/electric power system.

In some embodiments, the hydraulic/electric power system 100 further comprises a hydraulic oil heat exchanger or cooler. The hydraulic oil heat exchanger passes the hydraulic oil through tubing or a core which air or liquid cooled before reentering the hydraulic portion 200 of the hydraulic/electric power system 100.

In some embodiments, the hydraulic/electric power system 100 comprises a hydraulic oil filter 203*b*. As hydraulic oil passes through the hydraulic oil filter 203*b*, the hydraulic oil filter 203*b* traps and removes particulate matter, thereby preventing the ingress of foreign particle that may cause damage to the hydraulic portion of the hydraulic/electric power system 100. In various embodiments, the hydraulic oil filter is a bi-directional hydraulic oil filter 203*b*.

In some embodiments, hydraulic/electric power system 100 further comprises a hydraulic oil reservoir(s) 201. The hydraulic oil reservoir 201 is a container for holding the hydraulic oil required to supply the hydraulic portion of the hydraulic/electric power system 100. In various embodiments, the hydraulic oil reservoir 201 includes a reserve to cover any losses from minor leaks and evaporation in the hydraulic portion of the hydraulic/electric power system 100. The hydraulic oil reservoir 201 may include a vent to purge any evaporation. The hydraulic oil reservoir 201 may include a headroom space to allow for expansion of the hydraulic oil and permit air trapped in the hydraulic portion of the hydraulic/electric power system 100 to escape. In various embodiments, the hydraulic oil reservoir 201 is configured to help cool the hydraulic oil. For example, the hydraulic oil reservoir 201 may have a large surface area to facilitate heat transfer.

EXAMPLE PROCESS

Figure 3:
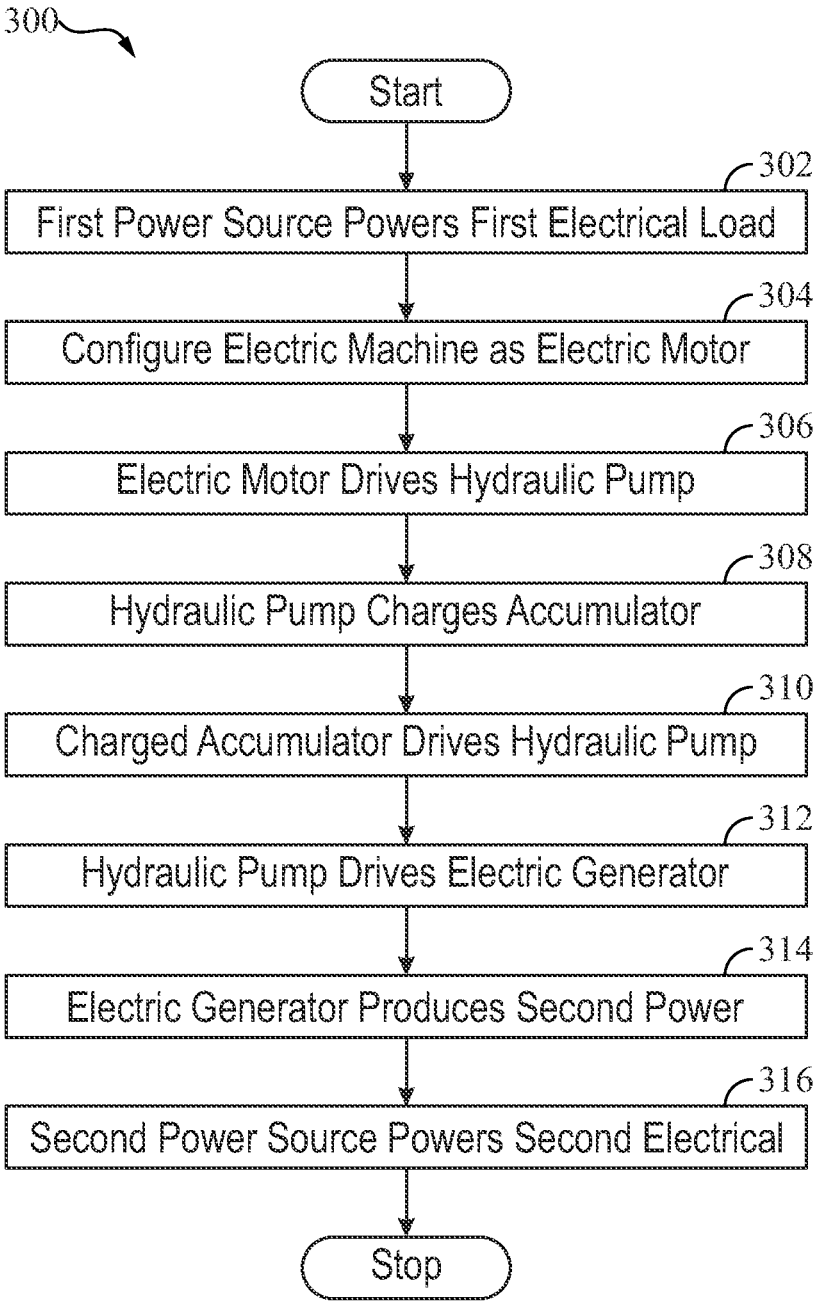
FIG. 3 is an example flowchart diagram of a process of using accumulator(s) to generate electrical power, in accordance with some embodiments.

FIG. 3 shows an example embodiment flow chart diagram of a process 300 using accumulator(s) 108 to generate electrical power in a marine environment. In some embodiments, the process 300 begins with step 302, in which a first controller 103 operates a first electrical load 104 powered by a first power source the system power supply 102. In step 304, and an electric machine 106 is configured to operate as an electric motor. In step 306, a hydraulic pump 107 is driven in a first direction by the electric motor. In step 308, the hydraulic pump 107 driven in the first direction by the electric motor charges an accumulator 108. In step 310, a charged accumulator 108 drives the hydraulic pump 107 in a second direction by discharging. In step 312, the hydraulic pump 107 operating in the second direction drives the electric machine 106 configured to operate as an electric generator. In step 314, the electric machine 106 (electric generator) produces a second power source. In step 316, a second controller 109 operates a second electrical load 110 powered by the second power source.

In some embodiments, operation of the accumulator 108 comprises several steps. In a first step, an accumulator 108 has no gas charge and may be empty. In a second step, the accumulator 108 can be pre-charged with gas, for example dry nitrogen. In a third step, the accumulator 108 can be charged until the hydraulic/electric power system 100 pressure exceeds the pre-charge pressure, and hydraulic fluid flows into the accumulator 108. In a fourth step, the accumulator 108 has been charged to the maximum pressure, the maximum amount of fluid has entered the accumulator 108. In a fifth step, the system pressure drops to handle the hydraulic and/or electrical load and the maximum pressure forces fluid from the accumulator 108. In various embodiments, the fluid is used to drive a hydraulic pump 107, which drives an electric machine 106 configured as an electric generator to generate another electrical power source 111. In a sixth step, fluid from the accumulator 108 is shut off when there is no longer a need to generator another electrical power source of the hydraulic/electric power system 100 reaches the minimum pressure needed to work. In a seventh step, the cycle repeats itself. Accumulator 108 charging begins when hydraulic fluid is admitted into the fluid side provided the charging pressure is greater than the pre-charge pressure. During the charging stage, the gas in the accumulator 108 is compressed to store hydraulic energy for future electrical generation. That is, the hydraulic pump 107 stores potential energy in the accumulator 108 during idle periods of the work cycle. The accumulator 108 transfers this reserve power back to the hydraulic/electric power system 100 when the cycle requires energy for the either electrical generator or drive hydraulic device(s). In various embodiments, this enables the hydraulic/electric power system 100 to utilize a much smaller hydraulic pump 107, resulting in savings in cost and power in the case of the hydraulic portion of the system. In various embodiments, this enables the hydraulic/electric power system 100 to utilize a much smaller electric motor and/or system power supply 102.

In some embodiments, the accumulator 108 can supplement the hydraulic pump 107 in delivering hydraulic power to the hydraulic system. The accumulator 108 is practically good at holding static hydraulic pressure in a hydraulic system and is more efficient than running a hydraulic pump 107 continuously.

While the use of an accumulator 108 has been described in a hydraulic system to support transient high flow rates and in a hydraulic/electric power system 100 to support transient high current demand in some embodiments the same accumulator 108 may be configured to support both requirements. For example, in a hybrid hydraulic/electric power system having both transient high flow rates and transient high current demand, in some embodiments, the same accumulator 108 can be configured to meet both requirements. In various embodiments, the same accumulator 108 can be configured to support either requirement in real time if they do not overlap. In some embodiments, the same accumulator 108 can be configured to support both requirements simultaneously if they do overlap.

In some embodiments, the same accumulator(s) 108 provide electrical power and hydraulic power. In some applications, this may be better accomplished with two separate accumulators 108. In various embodiments, there may be two accumulator 108 one to provide hydraulic power to the hydraulic portion of the hydraulic/electric power system 100 and one to provide electrical power to the electrical portion of the hydraulic/electric power system 100.

Figure 4:
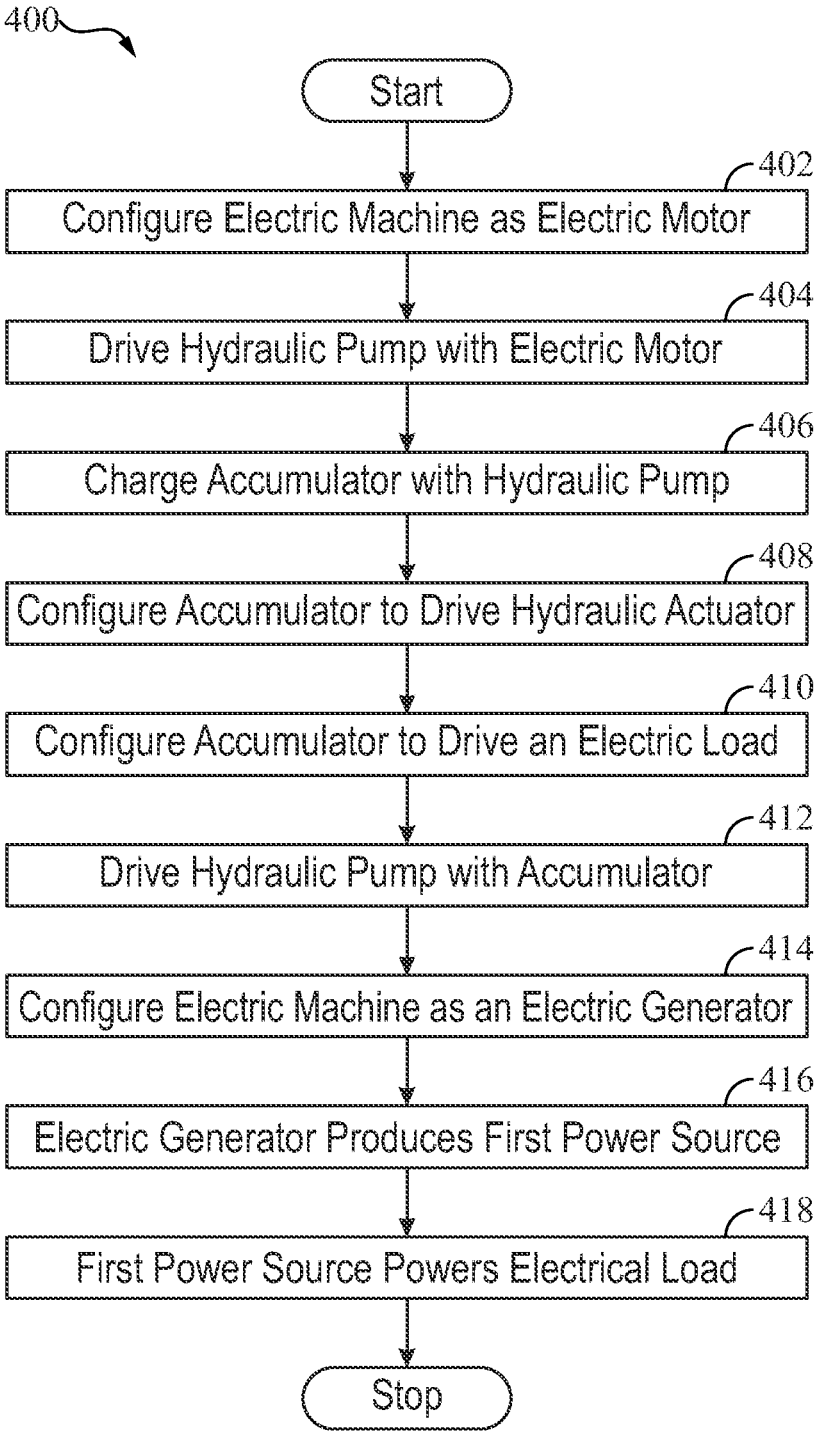
FIG. 4 is an example flowchart diagram of a process of using accumulator(s) to generate both electrical and hydraulic power, in accordance with some embodiments.

FIG. 4 shows an example embodiment flow chart diagram of a process of using accumulator(s) 108 to generate electrical power in a marine environment. In some embodiments, the process 400 begins with step 402 in which an electric machine 106 is configured to operate as an electric machine 106 (electric motor). In step 404, the electric motor drives a hydraulic pump 107 in a first direction. In step 406, the hydraulic pump 107 driven in the first direction by the electric machine 106 (electric motor) charges an accumulator 108. In step 408, the accumulator 108 is configured to drive a hydraulic load. The hydraulic load being a transient hydraulic load. In step 410, the accumulator 108 is configured to drive an electrical load. The electrical load being a transient load. In step 412, the hydraulic pump 107 is driven in a second by the discharging accumulator 108. In step 414, the electric machine 106 configured to operate as an electric generator is driven by the hydraulic pump 107. In step 416, the electric generator generators a second power source. In step 418, the second controller powered by the second controls the electrical load thereby maintains the power drawn from the output of a first power source at a constant level.

In some embodiments, the platforms, systems, media, and methods described herein include a computing device, processors, or use of the same. In further embodiments, the computing device includes one or more hardware central processing units (CPUs) or general-purpose graphics processing units (GPUs) that carry out the device's functions. In still further embodiments, the computing device further comprises an operating system configured to perform executable instructions. In some embodiments, the computing device is optionally connected a computer network. In further embodiments, the computing device is optionally connected to the Internet such that it accesses the World Wide Web. In still further embodiments, the computing device is optionally connected to a cloud computing infrastructure. In other embodiments, the computing device is optionally connected to an intranet. In other embodiments, the computing device is optionally connected to a data storage device.

In accordance with the description herein, suitable computing devices include, by way of non-limiting examples, cloud computing resources, server computers, server clusters, desktop computers, laptop computers, notebook computers, sub-notebook computers, netbook computers, net pad computers, handheld computers, mobile smartphones, and tablet computers. Those of skill in the art will recognize that many smartphones are suitable for use in the system described herein. Suitable tablet computers include those with booklet, slate, and convertible configurations, known to those of skill in the art.

In some embodiments, the computing device includes an operating system configured to perform executable instructions. The operating system is, for example, software, including programs and data, which manages the device's hardware and provides services for execution of applications. Those of skill in the art will recognize that suitable server operating systems include, by way of non-limiting examples, WAGO Programmable Logic Controller (PLC), FreeBSD, OpenBSD, NetBSD®, Linux, Apple® Mac OS X Server®, Oracle® Solaris®, Windows Server®, and Novell® NetWare®. Those of skill in the art will recognize that suitable personal computer operating systems include, by way of non-limiting examples, Microsoft® Windows®, Apple® Mac OS X®, UNIX®, and UNIX-like operating systems such as GNU/Linux. In some embodiments, the operating system is provided by cloud computing. Those of skill in the art will also recognize that suitable mobile smartphone operating systems include, by way of non-limiting examples, Nokia® Symbian® OS, Apple® iOS®, Research In Motion® BlackBerry OS®, Google® Android®, Microsoft® Windows Phone® OS, Microsoft® Windows Mobile® OS, Linux®, and Palm® WebOS®.

In some embodiments, the computing device includes a storage and/or memory device. The storage and/or memory device is one or more physical apparatuses used to store data or programs on a temporary or permanent basis. In some embodiments, the device is volatile memory and requires power to maintain stored information. In some embodiments, the device is non-volatile memory and retains stored information when the computing device is not powered. In further embodiments, the non-volatile memory comprises flash memory. In some embodiments, the non-volatile memory comprises dynamic random-access memory (DRAM). In some embodiments, the non-volatile memory comprises ferroelectric random-access memory (FRAM). In some embodiments, the non-volatile memory comprises phase-change random access memory (PRAM). In other embodiments, the device is a storage device including, by way of non-limiting examples, CD-ROMs, DVDs, flash memory devices, magnetic disk drives, magnetic tapes drives, optical disk drives, and cloud computing-based storage. In further embodiments, the storage and/or memory device is a combination of devices such as those disclosed herein.

In some embodiments, the computing device includes a display to send visual information to a user. In some embodiments, the display is a cathode ray tube (CRT). In some embodiments, the display is a liquid crystal display (LCD). In further embodiments, the display is a thin film transistor liquid crystal display (TFT-LCD). In some embodiments, the display is an organic light emitting diode (OLED) display. In various further embodiments, on OLED display is a passive-matrix OLED (PMOLED) or active-matrix OLED (AMOLED) display. In some embodiments, the display is a plasma display. In other embodiments, the display is a video projector. In yet other embodiments, the display is a head-mounted display in communication with a computer, such as a virtual reality (VR) headset. In further embodiments, suitable VR headsets include, by way of non-limiting examples, HTC Vive, Oculus Rift, Samsung Gear VR, Microsoft HoloLens, Razer Open-Source Virtual Reality (OSVR), FOVE VR, Zeiss VR One, Avegant Glyph, Freefly VR headset, and the like. In still further embodiments, the display is a combination of devices such as those disclosed herein.

In various embodiments, the computing device utilizes a WAGO PLC and CODESYS is the development software, each of which are controlled thru a Windows based Human Machine Interface (HMI).

In some embodiments, the computing device includes an input device to receive information from a user. In some embodiments, the input device is a keyboard. In some embodiments, the input device is a pointing device including, by way of non-limiting examples, a mouse, trackball, track pad, joystick, game controller, or stylus. In some embodiments, the input device is a touch screen or a multi-touch screen. In other embodiments, the input device is a microphone to capture voice or other sound input. In other embodiments, the input device is a video camera or other sensor to capture motion or visual input. In further embodiments, the input device is a Kinect, Leap Motion, or the like. In still further embodiments, the input device is a combination of devices such as those disclosed herein.

Figure 5:
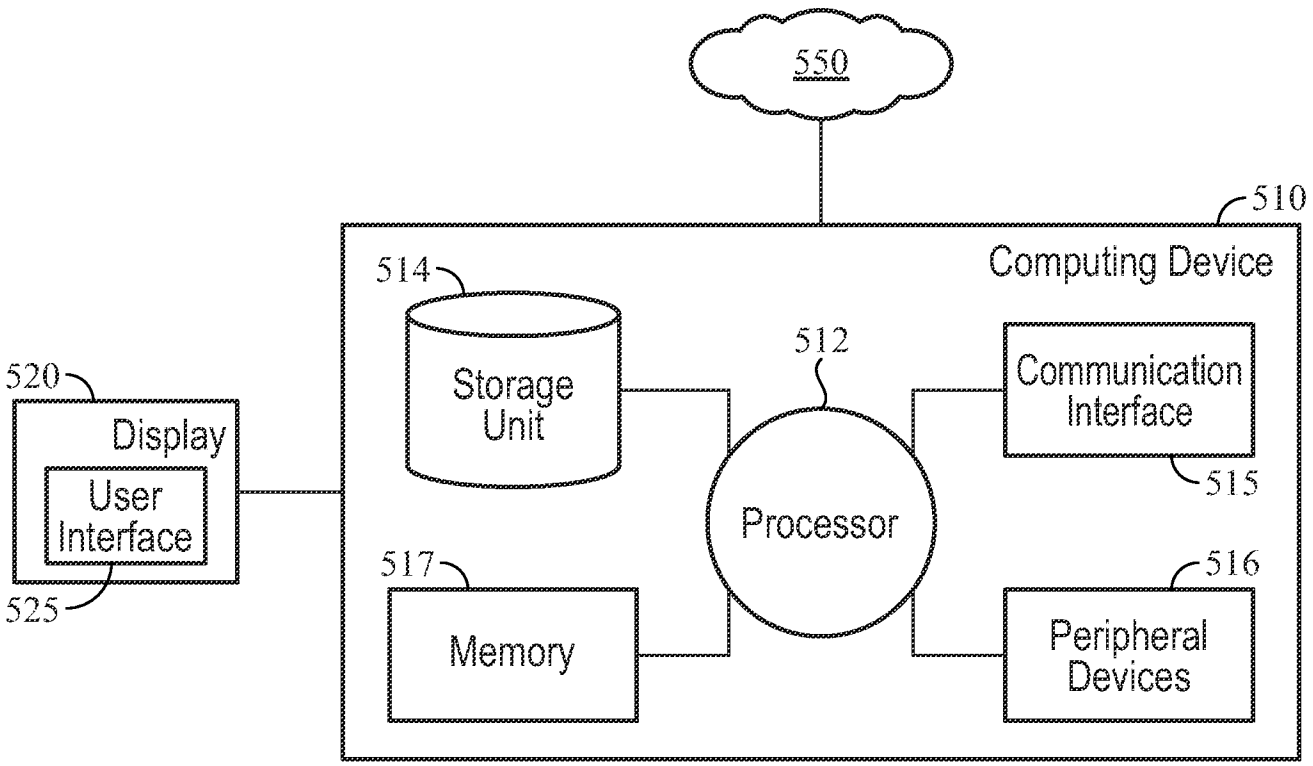
FIG. 5 is a non-limiting example of a computing device; in this case, a device with one or more CPUs, a memory, a communication interface, and a display, in accordance with some embodiments.

FIG. 5, shows an example computing device 510 that can be programmed or otherwise configured to implement platforms, systems, media, and methods of the present disclosure.

In the depicted embodiment, of FIG. 5 the computing device 510 includes a CPU (also "processor" and "computer processor" herein) 512, which is optionally a single core, a multi core processor, or a plurality of processors for parallel processing. The computing device 510 also includes memory or memory location 517 (e.g., random-access memory, read-only memory, flash memory), electronic storage unit 514 (e.g., hard disk), communication interface 515 (e.g., a network adapter) for communicating with one or more other systems, and peripheral devices 520, 525, such as cache, other memory, data storage, user interface or electronic display adapters.

In some embodiments, the memory 517, storage unit 514, interface 515 and peripheral devices 520, 525 are in communication with the CPU 512 through a communication bus (solid lines), such as a motherboard. The storage unit 514 comprises a data storage unit (or data repository) for storing data. The computing device 510 is optionally operatively coupled to a computer network, such as the network 550 depicted in FIG. 5, with the aid of the communication interface 525.

In some embodiments, the CPU 512 can execute a sequence of machine-readable instructions, which can be embodied in a program or software. The instructions may be stored in a memory location, such as the memory 517. The instructions can be directed to the CPU 512, which can subsequently program or otherwise configure the CPU 512 to implement methods of the present disclosure. Examples of operations performed by the CPU 512 can include fetch, decode, execute, and write back. In some embodiments, the CPU 512 is part of a circuit, such as an integrated circuit. One or more other components of the computing device 510 can be optionally included in the circuit. In some embodiments, the circuit is an application specific integrated circuit (ASIC) or a field programmable gate array (FPGA).

In some embodiments, the storage unit 514 can store files, such as drivers, libraries and saved programs. In some embodiments, the storage unit 514 stores data, such as detection logic; analysis of various threats that have been encountered by an enterprise; metadata regarding triage performed to mitigate threats, false positives, and performance metrics, and so forth. In some embodiments, the computing device 510 includes one or more additional data storage units that are external, such as located on a remote server that is in communication through an intranet or the Internet.

In some embodiments, the computing device 510 communicates with one or more remote computer systems through a network. For instance, the computing device 510 can communicate with a remote computer system. Examples of remote computer systems include personal computers (e.g., portable PC), slate or tablet PCs (e.g., Apple® iPad, Samsung® Galaxy Tab, etc.), smartphones (e.g., Apple® iPhone, Android-enabled device, Blackberry®, etc.), or personal digital assistants, such as depicted in FIG. 5. In some embodiments, a user can access the computing device 510 via a network 550, such as depicted in FIG. 5.

In some embodiments, the platforms, systems, media, and methods as described herein are implemented by way of machine (e.g., computer processor) executable code stored on an electronic storage location 514 of the process device, such as, for example, on the memory 517 or the electronic storage unit 514. In some embodiments, the CPU 512 is adapted to execute the code. In some embodiments, the machine executable or machine-readable code is provided in the form of software. In some embodiments, during use, the code is executed by the CPU 512. In some embodiments, the code is retrieved from the storage unit 514 and stored on the memory 517 for ready access by the CPU 512. In some situations, the electronic storage unit 514 is precluded, and machine-executable instructions are stored on the memory 517. In some embodiments, the code is pre-compiled. In some embodiments, the code is compiled during runtime. The code can be supplied in a programming language that can be selected to enable the code to execute in a pre-compiled or as-compiled fashion.

In some embodiments, the computing device 510 can include or be in communication with an electronic display 520. In some embodiments, the electronic display 520 provides a user interface (UI) 525. In a preferred embodiment the computing device 510 utilizes a WAGO PLC controlled thru a Windows based Human Machine Interface (HMI).

In some embodiments, the platforms, systems, media, and methods disclosed herein include one or more non-transitory computer readable storage media encoded with a program including instructions executable by the operating system of an optionally networked computing device. In further embodiments, a computer readable storage medium is a tangible component of a computing device. In still further embodiments, a computer readable storage medium is optionally removable from a computing device. In some embodiments, a computer readable storage medium includes, by way of non-limiting examples, CD-ROMs, DVDs, flash memory devices, solid state memory, magnetic disk drives, magnetic tape drives, optical disk drives, distributed computing systems including cloud computing systems and services, and the like. In some cases, the program and instructions are permanently, substantially permanently, semi-permanently, or non-transitorily encoded on the media.

In some embodiments, the platforms, systems, media, and methods disclosed herein include at least one computer program, or use of the same. A computer program includes a sequence of instructions, executable in the computing device's CPU, written to perform one or more specified tasks. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages. One such development environment for programming controller applications as used herein is CODESYS, for engineering control systems. The software suite covers different aspects of industrial automation technology with one surface. The tool is independent from device manufacturers and thus used for hundreds of different controllers, PLCs (programmable logic controllers), PAC (programmable automation controllers), ECUs (electronic control units), controllers for building automation and other programmable controllers mostly for industrial purposes.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft®.NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft® SQL Server, mySQL™, and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous JavaScript and XML (AJAX), Flash® ActionScript, JavaScript, or Silverlight®. In some embodiments, a web application is written to some extent in a server-side coding language such as Active Server Pages (ASP), ColdFusion®, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft® Silverlight®, Java™, and Unity®.

In some embodiments, a computer program includes a mobile application provided to a mobile computing device. In some embodiments, the mobile application is provided to a mobile computing device at the time it is manufactured. In other embodiments, the mobile application is provided to a mobile computing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C#, Objective-C, Java™, JavaScript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Google® Play, Chrome Web Store, BlackBerry® App World, App Store for Palm devices, App Catalog for webOS, Windows® Marketplace for Mobile, Ovi Store for Nokia® devices, Samsung® Apps, and Nintendo® DSi Shop.

In some embodiments, the platforms, systems, media, and methods disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

Further still, one of skill in the art would recognize upon this disclosure that in any one of the embodiments described herein, the hydraulic/electric power system 100 may contain at least on pressure dampener/silencer/suppressor used to condition/smooth/quite the hydraulic fluid. These elements may be placed anywhere within the hydraulic/electric power system 100 including but not limited to the suction line, the pressure line, the return line, an auxiliary line or a case drain line.

Further still, one of skill in the art would recognize upon this disclosure that in any one of the embodiments described herein, the hydraulic/electric power system 100 may contain at least one or more additional valves in addition to the one previously described to facilitate hydraulic power unit controls. This valve may be placed anywhere within the hydraulic/electric power system 100 including but not limited to the suction line, the pressure line, the return line, an auxiliary line or a case drain line.

Further still, one of skill in the art would recognize upon this disclosure that in any one of the embodiments described herein, the hydraulic/electric power system 100 may contain at least one hydraulic oil cooler/heater somewhere in the hydraulic/electric power system 100 used to condition the fluid. These elements can be located anywhere within the hydraulic/electric power system 100 including but not limited to the suction line, the pressure line, the return line, an auxiliary line, a case drain line, or a reservoir.

Still further, one of skill in the art would recognize upon this disclosure that in any one of the embodiments described herein, the hydraulic/electric power system 100 may contain at least one pressure filter, suction filter, or return filter somewhere in the hydraulic/electric power system 100 used to clean/condition/filter the fluid. These filters can be located anywhere within the hydraulic/electric power system 100 including but not limited to the suction line, the pressure line, the return line, an auxiliary line or a case drain line.

Still further, one of skill in the art would recognize upon this disclosure that in any one of the embodiments described herein, the hydraulic/electric power system 100 may contain at least one or more additional sensors in addition to the one previously described to facilitate hydraulic power unit controls. These sensors may be placed anywhere within the hydraulic/electric power system 100 including but not limited to the suction line, the pressure line, the return line, an auxiliary line, a case drain line, or a reservoir.

Still further, one of skill in the art would recognize upon this disclosure that in any one of the embodiments described herein, the hydraulic/electric power system 100 may contain at least one or more additional pumps in addition to the one previously described to facilitate hydraulic power unit controls. These pumps may be placed anywhere within the hydraulic/electric power system 100 including but not limited to the suction line, the pressure line, the return line, an auxiliary line, a case drain line, or a reservoir.

Finally, one of skill in the art would recognize upon this disclosure that in any one of the embodiments described herein, the hydraulic/electric power system 100 may contain at least one or more additional accumulators 108 in addition to the one previously described to facilitate hydraulic power unit controls. These accumulators 108 may be placed anywhere within the hydraulic/electric power system 100 including but not limited to the suction line, the pressure line, the return line, an auxiliary line, or a case drain line.

While preferred embodiments of the present invention have been shown and described herein, it will be obvious to those skilled in the art that such embodiments are provided by way of example only. Numerous variations, changes, and substitutions will now occur to those skilled in the art without departing from the invention, in accordance with the claims. It should be understood that various alternatives to the embodiments of the invention described herein may be employed in practicing the invention.

What is claimed is:

1. A hydraulic/electric power system, comprising:

a first power source operable to draw power from a generator; an electric machine operably coupled to the first power source;

a hydraulic pump operably coupled to the electric machine wherein the hydraulic pump is a variable displacement hydraulic (VDH) pump, and wherein the VDH pump is at least one of an axial piston pump, radial piston pump, bent axial piston pump, and vane pump;

an accumulator that is a hydraulic energy storage device and is operably coupled to the hydraulic pump;

a first controller operable to control a first electrical load powered by the first power source; and a second controller operable to control a second electrical load powered, at least in part, by a second power source, wherein the electric machine operates as an electric motor, the electric motor drives the hydraulic pump in a first direction and the first direction charges the accumulator, and wherein a charged accumulator drives the hydraulic pump in a second direction and the second direction drives the electric machine, and wherein the electric machine operates as an electric generator to generate a second power source.

2. The hydraulic/electric power system of claim 1, wherein the electric motor drives the hydraulic pump in the first direction, charging the accumulator when the second controller is not operating the second electrical load.

3. The hydraulic/electric power system of claim 1, wherein the electric generator is driven by the hydraulic pump in the second direction by a discharging accumulator when the second controller is operating the second electrical load.

4. The hydraulic/electric power system of claim 1, wherein the hydraulic pump is a fixed displacement hydraulic (FDH) pump, and wherein the FDH pump is one of an axial piston pump, a radial piston pump, a bent axial piston pump, and vane pump.

5. The hydraulic/electric power system of claim 4, further comprises one or more of a capacitor bank and a supercapacitor bank operable to power the second electrical load for a period of time that is less than an on period of time corresponding to a duration of the second direction.

6. The hydraulic/electric power system of claim 1, wherein the hydraulic energy storage device comprises one or more accumulators, and wherein the one or more accumulators have different energy capacities or energy densities.

7. The hydraulic/electric power system of claim 1, wherein the accumulator is a bladder type accumulator having a response time of less than 25 milliseconds, and wherein a capacity of the bladder type accumulator is between ¼ gallon and 15 gallons.

8. The hydraulic/electric power system of claim 1, wherein a supply voltage of the first power source is maintained at a constant level by the second power source, and wherein the supply voltage is between 200 volts and 700 volts alternating current (VDC).

9. The hydraulic/electric power system of claim 1, wherein the second load is a transient load with a duty cycle having an off period of time corresponding to a duration of the first direction and an on period of time corresponding to a duration of the second direction, and wherein a size of the accumulator and a number of accumulators is determined by a size of the duty cycle.

10. The hydraulic/electrical power system of claim 1, further comprising:

a third controller operable to control a first hydraulic load, wherein the first hydraulic load is a motion control device, and a fourth controller operatable to control a second hydraulic load, wherein the motion control device is one or more of a hydraulic pump, a linear actuator, a servo motor, wherein the second hydraulic load is a transient second hydraulic load, and wherein the accumulator is operable to power the transient second hydraulic load.

11. A method of using accumulator(s) to generate electrical power in a marine environment, the method comprising:

powering with a first power source a first electrical load controlled by a first controller;

configuring an electric machine to operate as an electric motor;

driving a hydraulic pump in a first direction with the electric motor;

charging an accumulator with the hydraulic pump driven in the first direction by the electric motor;

driving the hydraulic pump in a second direction with the accumulator operable to discharge;

driving the electric machine configured to operate as an electric generator with the hydraulic pump;

generating a second power source with the electric generator, wherein generating the second power source with the electric generator requires a minimum working pressure of gas, wherein the pre-charge pressure gas is about one third of a minimum working pressure of gas; and powering with the second power source a second electrical load controlled by a second controller.

12. The method of claim 11, further comprising, pre-charging the accumulator until a pressure of a gas within the accumulator exceeds a pre-charge pressure of the gas and a volume of the gas within the accumulator begins to compress and decrease;

filling the accumulator with a hydraulic fluid to set a minimum fluid level;

continuing to charge the accumulator, wherein a volume of a liquid within the accumulator increases and the volume of the gas within the accumulator is further compressed and decreased; and stopping the charging of the accumulator when the pressure of the gas within the accumulator reaches a maximum pressure.

13. The method of claim 11, wherein the minimum working pressure of gas is 1,000 psi and the maximum working pressure of gas is 3,000 psi.

14. The method of claim 11, wherein the second electrical load has an intermittent power level that cannot be met by the first power source, wherein the electric motor driving the hydraulic pump to charge the accumulator is driven by a constant current that is less than a peak transient current drawn by the second load, and wherein at least an output power of the first power source is maintained at a constant level by the second power source.

15. The method of claim 14, wherein a duration of the constant current is greater than a duration of the peak transient current drawn by the second electrical load.

16. The method of claim 11, wherein the accumulator is charged with a remote gas bottle, and wherein the remote gas bottle is filled with a dry nitrogen gas.

17. A method of using an accumulator(s) to generate electrical power in a marine environment, the method comprising:

configuring an electric machine to operate as an electric motor;

driving a hydraulic pump in a first direction with the electric motor, wherein the electric motor is powered by an output of a first electric power source;

charging an accumulator with the hydraulic pump driven in the first direction by the electric motor;

configuring the accumulator to drive a hydraulic actuator, wherein the hydraulic actuator is a hydraulic transient load; and configuring the accumulator to drive an electrical load, wherein the electrical load is a transient electrical load, and wherein configuring the accumulator to drive the electrical load comprises:

discharging the accumulator to drive the hydraulic pump in a second direction;

driving the electric machine operating as an electric generator with the hydraulic pump;

generating a second power source with the electric generator;

controlling the electrical load with a second controller powered by the second power source; and maintaining a power drawn from the output of the first power source a constant level.

18. The method of claim 17, further comprising;

configuring the electric machine to operate as an electric motor;

driving the hydraulic pump in a first direction with the electric motor, wherein the electric motor is powered by the first electric power source; and charging the accumulator with the hydraulic pump driven in the first direction by the electric motor between the hydraulic transient load and the transient electrical load, and vice versa.

* * * * *